US007424813B2

(12) United States Patent
Wu

(10) Patent No.: US 7,424,813 B2
(45) Date of Patent: Sep. 16, 2008

(54) STRAP LOCK WITH BOTH FUNCTIONS OF COMBINATION CODE SETTING AND KEY OPERATION

(75) Inventor: Chien Hung Wu, Taipei County (TW)

(73) Assignee: Sinox Co., Ltd., Taipei County (TW)

( * ) Notice: Subject to any disclaimer, the term of this patent is extended or adjusted under 35 U.S.C. 154(b) by 0 days.

(21) Appl. No.: 11/546,443

(22) Filed: Oct. 12, 2006

(65) Prior Publication Data

US 2007/0084256 A1 Apr. 19, 2007

(30) Foreign Application Priority Data

Oct. 14, 2005 (TW) ..... 94135861 A

(51) Int. Cl.
*E05B 69/00* (2006.01)

(52) U.S. Cl. ..... 70/58; 70/21; 70/18

(58) Field of Classification Search ..... 70/18, 70/58, 69, 284, 285, 312, 21, 25–30, 432–437
See application file for complete search history.

(56) References Cited

U.S. PATENT DOCUMENTS

| | | | | |
|---|---|---|---|---|
| 6,877,345 | B1 * | 4/2005 | Misner et al. | 70/25 |
| 6,883,354 | B1 * | 4/2005 | Yu | 70/18 |
| 6,912,879 | B1 * | 7/2005 | Yu | 70/58 |
| 7,007,521 | B1 * | 3/2006 | Misner et al. | 70/21 |
| 7,104,095 | B1 * | 9/2006 | Lin | 70/58 |
| 7,159,422 | B1 * | 1/2007 | Misner et al. | 70/21 |
| 7,201,026 | B2 * | 4/2007 | Yu | 70/21 |
| 2005/0155397 | A1 * | 7/2005 | Yu | 70/58 |
| 2006/0150690 | A1 * | 7/2006 | Lai et al. | 70/21 |
| 2006/0207301 | A1 * | 9/2006 | Yu | 70/58 |
| 2006/0260369 | A1 * | 11/2006 | Lai et al. | 70/38 C |
| 2006/0272368 | A1 * | 12/2006 | Yu | 70/58 |
| 2007/0175247 | A1 * | 8/2007 | Yu | 70/58 |

OTHER PUBLICATIONS

Samsonite Locking luggage Strap, E&B Giftware, LLC website, 2005.*

* cited by examiner

*Primary Examiner*—Suzanne D Barrett
(74) *Attorney, Agent, or Firm*—Birch, Stewart, Kolasch & Birch, LLP

(57) ABSTRACT

The present invention is in related to a strap lock with both functions of combination code setting and key operation and comprises a lock body being unlocked or locked and a buckle being hasped or separated from the lock body when the lock body being unlocked, the buckle and the lock body are connected each other via a binder so as to that a baggage being bound and buckled; the lock body has a combination locking mechanism and a key device simultaneously, thus the officer for security checking can use a special key to unlock the lock body via the key device, and the lock body can be unlocked without damaging. Besides, the lock body further has an indicator, which can be shifted to a different position after the lock body is unlocked by the key. Thus, the owner of the baggage know whether the baggage being opened or not by means of the displaying position of the indicator.

19 Claims, 12 Drawing Sheets

STRAP LOCK WITH BOTH FUNCTIONS OF COMBINATION CODE SETTING AND KEY OPERATION

FIELD OF THE INVENTION

The present invention is in related to a strap lock, which is applied to bind and luck a baggage or backpack for assuring the safety during delivery or traveling, especially to the strap lock being operated by both setting a combination code and a key operation; specifically, the strap lock further includes an indicator with the features of resetting and visual ability. The indicator is driven simultaneously when the strap lock is operated by the key, and the indicator is able to return to an original position thereof only when the strap lock is unlocked by way of setting a combination code.

BACKGROUND OF THE INVENTION

The strap lock is a kind of locking equipment that is capable of binding a luggage case to prevent the luggage case from being opened by the other person without permission.

The strap lock with the function of setting combination code or key operation has existed already, but the strap lock can not be unlocked if the combination code is forgotten or the key is lost.

On the other hand, because every country has put a lot of attention on the safety of the airport, taking USA as the example, when TSA (Transportation Security Administration) in USA has taken in charge in the security checking for airports, security persons may check any suspicious baggage for considering safety; but the lock of the suspicious locked luggage case are always damaged due to the combination codes or the keys are not known by the security persons.

Not only are the damaged locks for the owners losses, and but also the with the damaged locks is short of protection for the rest of delivery or traveling. Therefore the goods inside the luggage are risky to be stolen.

For the issue that the luggage case may be damaged, TSA has decided to adopt the suggestion of the Travel Sentry to provide override keys. The override keys let the officers in the department of security directly and easily unlock and check the suspicious luggage case without breaking the locks of the luggage cases. But the override key is not provided for the general customers or travelers.

To be suited for the suggestion of the Travel Sentry, the lock producers have to offer the lock equipment with the functions of both locking and unlocking general luggage and locked and unlocked by special keys.

For the present products, the lock equipment with the functions of combination code setting and key operation and another lock equipment operated by two different keys are the needs at the present time.

When the special lock equipments are applied to the luggage case, the special lock equipments can be re-locked after the checking is finished, and the luggage case is still protected after checking.

For the strap lock, the products with the functions of combination code setting and key operation do exist but just a few. Thus the options for such lock tools are not satisfied to consumers.

Else, even if the lock tool having an indicator is not innovative, but the prior art of the strap lock does not have such indicator, or any technology teaches such information.

SUMMARY OF THE INVENTION

According to the description mentioned in "Background of the Invention", the present invention provides a strap lock with both functions of combination code setting and key operation. When the strap lock binding a baggage case and the baggage case is checked for security, the officer may unlock the strap lock via an override key. Consequently, the strap lock can be re-locked after checking the baggage case, and the strap lock can not be damaged as well.

Further more, the strap lock cooperates with the indicator with the feature of reset. The indicator may appear the situation that the strap lock is unlocked by a key, so the owner is notified by the two conditions of the strap lock being unlocked for safety checking or someone attempting to unlock the strap lock.

To approach above objectives, the preferred embodiment is to provide both a combination locking mechanism and a key device for the strap lock. As a result, any of the combination locking mechanism and the key device is operated to make the strap lock be locked or unlocked.

The strap lock comprises a lock body being opened and closed, the lock body has a button, which buckles the lock body when the lock body is closed, and the button is pressed to release the lock body. The combination locking mechanism combines with the button, and whether the button being moved or not may depend on a combination code. The key device is installed on the lock body, and even though the button is restricted to move by the combination locking mechanism to buckle the lock body, the key device still release the lock body.

Besides, the lock body further has an indicator, the indicator can be seen via a window via a case of the lock body and placed on a first position normally, and the indicator is previously locked by a combination code and may then be shifted to a second position after unlocking the lock body by means of a key. When the strap lock being applied to a baggage and once the strap lock being unlocked for security checking, the indicator is shifted from the first position to the second position, the owner of the baggage knows the baggage is opened. To return the indicator to the first position, the only way is to unlock the lock body by a combination code and stir by hand.

When the lock body is unlocked by the key, the indicator is shifted to the second position; but if the lock body is re-locked by the key, the indicator keeps stopping on the second position. To return the indicator to the first position, the only way is by handy stirring.

Wherein a plurality of displaying surface areas of the indicator may apply different colors or icons for different visualizations when the indicator is in different positions.

DETAILED DESCRIPTION OF THE PREFERRED EMBODIMENTS

Figure 1:
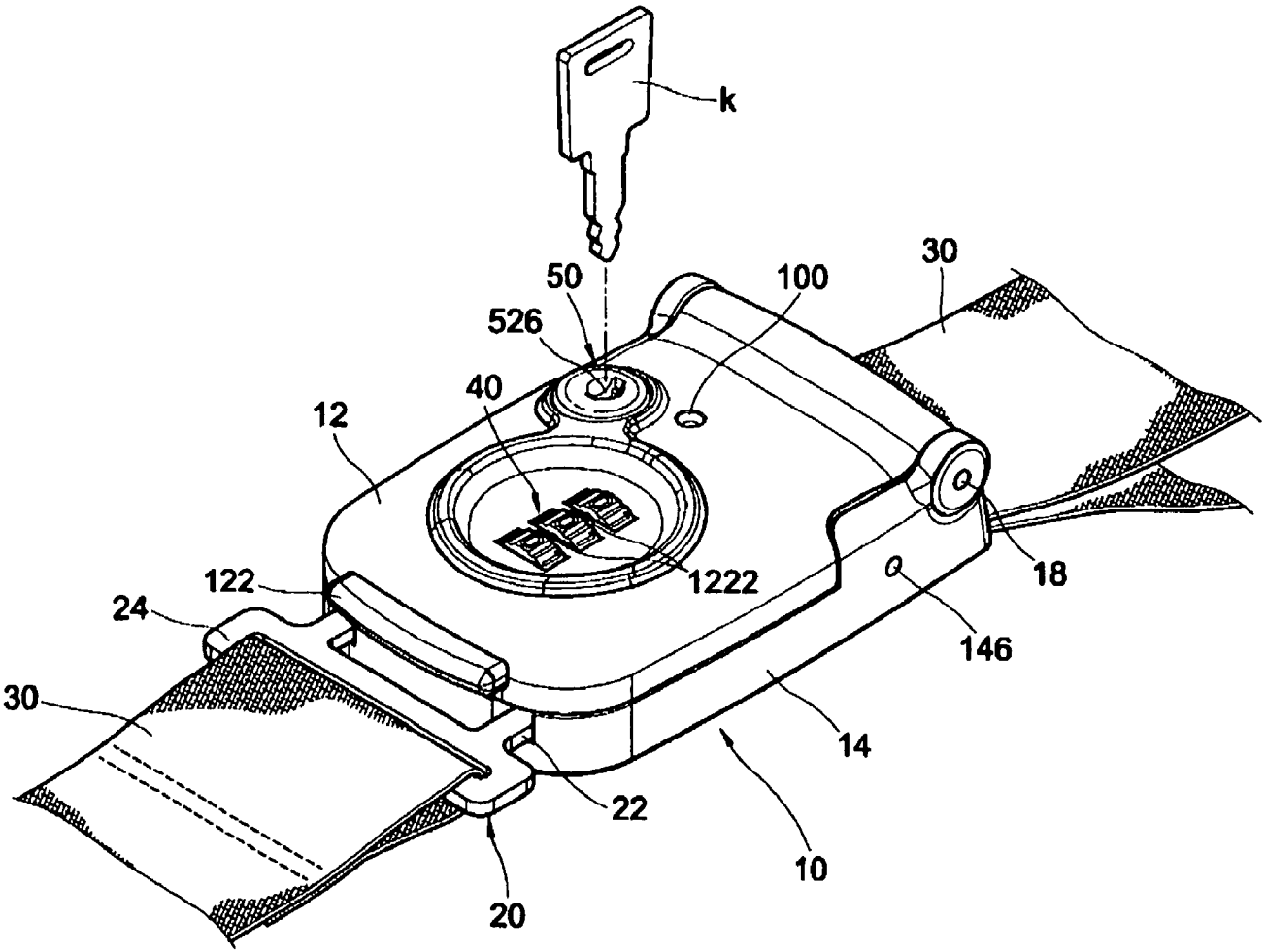
FIG. 1 is a perspective sketch of a strap lock with both functions of combination code setting and key operation of the present invention, a lock body of the strap lock is locked, and a key can be inserted into the lock body.
Figure 2:
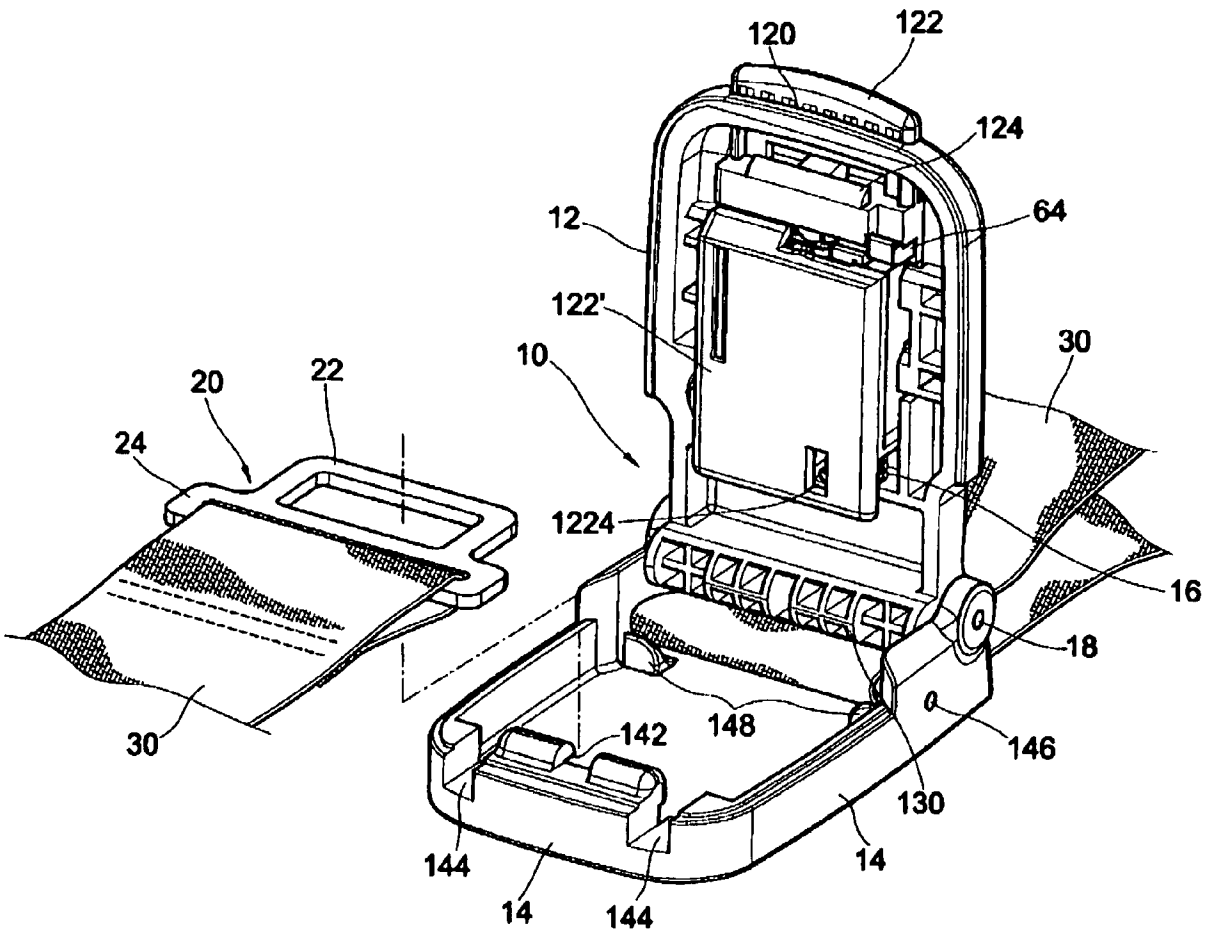
FIG. 2 is a perspective sketch of a buckle off the lock body of the present invention, the strap lock is locked.

Please refer to FIG. 1 and FIG. 2, which illustrates a strap lock with both functions of combination code setting and key operation. The strap lock comprises a lock body 10 capable of being unlocked and locked and a buckle 20 with a first end and a second end. The first end may be hasped to or separate from the lock body 10 when the lock body 10 is unlocked. The second end is connected to the lock body 10 by means of a binder 30. Therefore, a closed ring is formed when the first end is hasped and the second end is connected to the lock body 10. And the strap lock can be bond with a luggage case when traveling to prevent the luggage from being opened by others without permission.

The lock body 10 includes two devices for locking and unlocking. One is a combination locking mechanism 40 locked and unlocked by combination code, another is a key device 50 locked and unlocked by inserting and rotating a key K. After unlocking the lock body 10 by means of the combination locking mechanism 40 or the key device 50, a button 122 can be pressed inward and then lock body 10 is lift up to separate the buckle 20 from the lock body 103 or the hasped connection is repeated.

Besides, there is an indicator in the lock body 10 and a window 100 on the shell of the lock body 10 for viewing the indicator.

The connection of the lock body 10, the buckle 20 and the binder 30 is described in detail as the following: a fillister 114 is formed in each of two sides of the front end of a bottom cover 14. The buckle 20 straddles on or takes off the fillisters 144 when a top cover 12 and the bottom cover 14 are unlocked.

Figure 4:
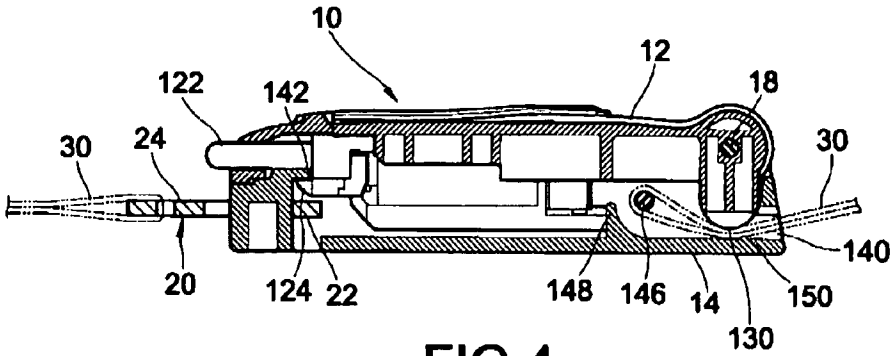
FIG. 4 is a sketch of an A-A profile of the lock body of FIG. 3 of the present invention, a dot line presents a partial binder.
Figure 5:
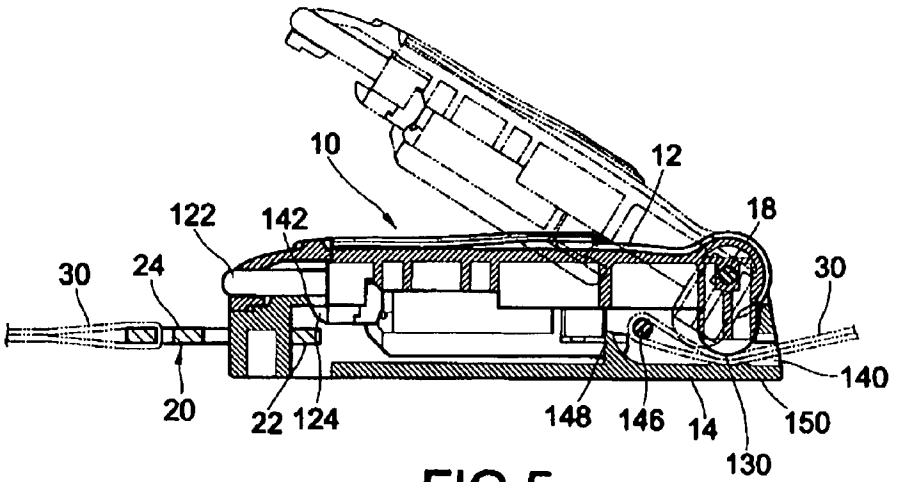
FIG. 5 is a sketch of variable shifted positions of a force-applied button moving into an internal of the lock body of FIG. 4 of the present invention, a dot line presents the state of the lock body being opened.
Figure 3:
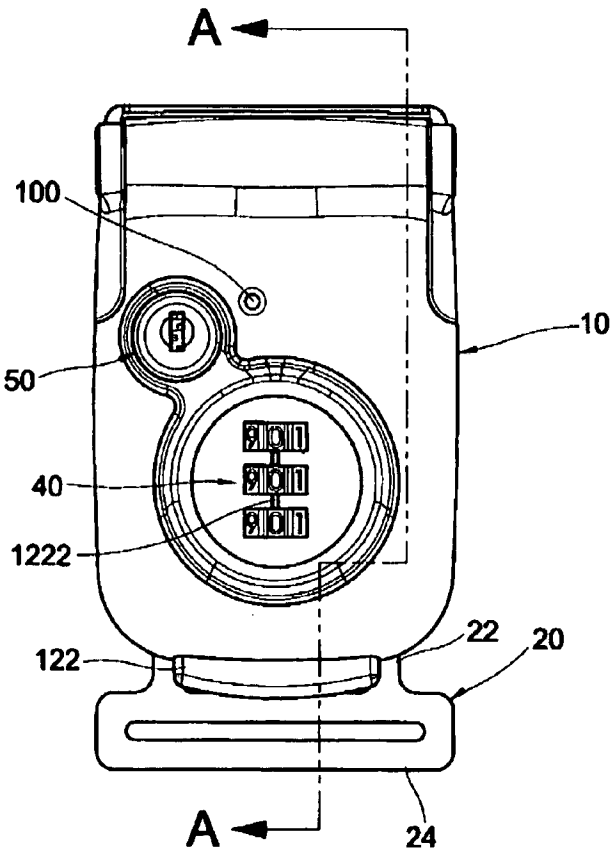
FIG. 3 is a top view of the strap lock without a binder of the present invention.

Please refer to FIG. 3, FIG. 4 and FIG. 5 simultaneously, a first ring portion 22 capable of being placed across the fillisters 144 is formed in the buckle 20, and a second ring portion 24 capable of being connected to the binder 30 is also formed in the buckle 20. A rear end of the bottom cover 14 includes an open-ended trough 140 for the binder 30 to be inserted into the lock body 10, and a dangling rod 146 supported by two lateral walls in the rear end of cover 14 to be surrounded by the binder 30, and the binder 30 is pull out from the open-ended trough 140. Besides, a ridge 148 locates on the internal surface of the bottom cover 14 and below the dangling rod 148 as a stopper of the binder 30 when inserted into the lock body 10. Moreover, one traversing rib 150 is set on the location closer to the internal surface of the rear end of the bottom cover 14. A non-smooth batten 130 locates on the rear edge of the rear end of the top cover 12. Therefore, the traversing ribs 150 and the batten 130 function to clamp the binder 30 when the top cover 12 and the bottom cover 14 cover each other.

Figure 6:
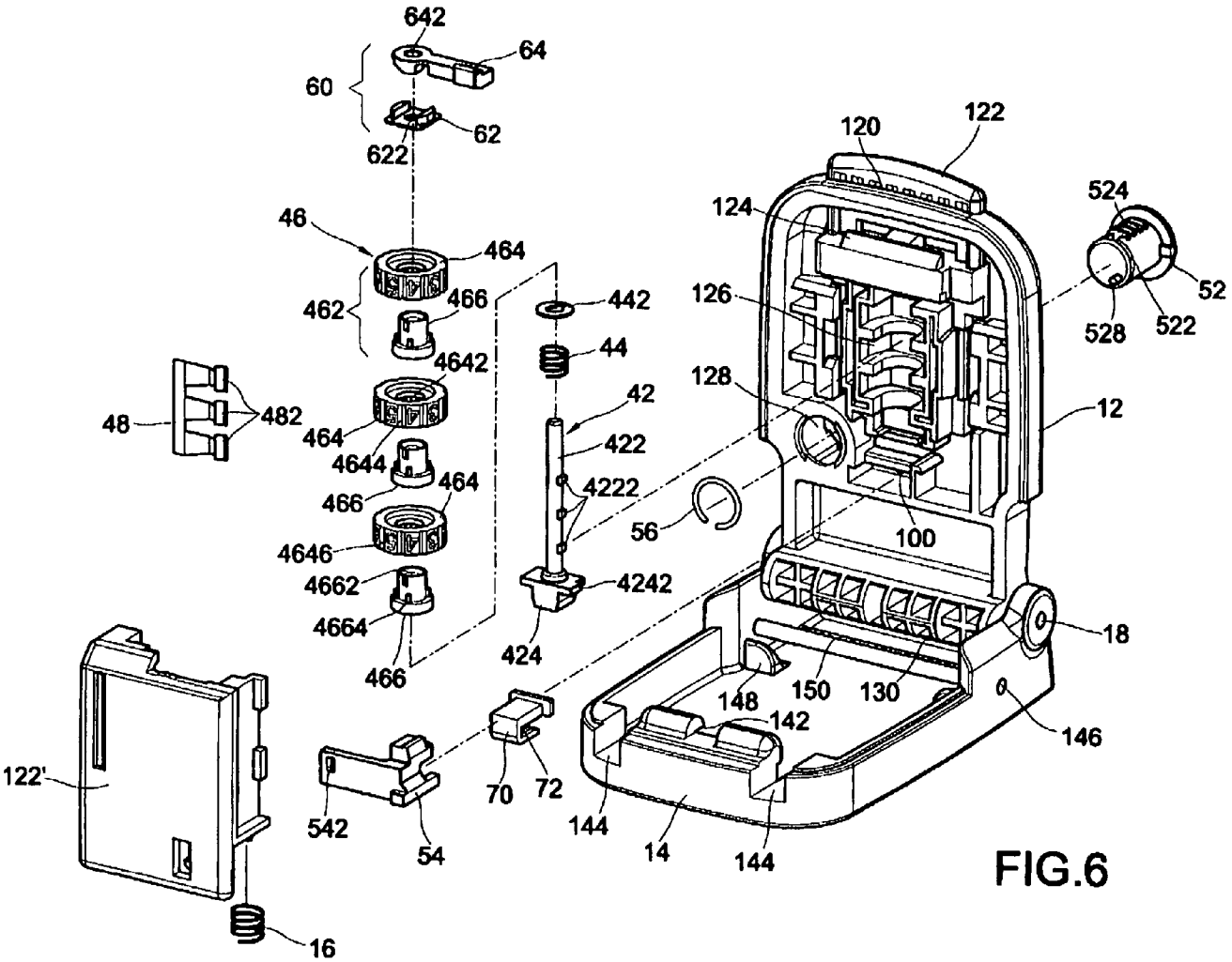
FIG. 6 is an exploded sketch of the lock body of the strap lock of the present invention.
Figure 7:
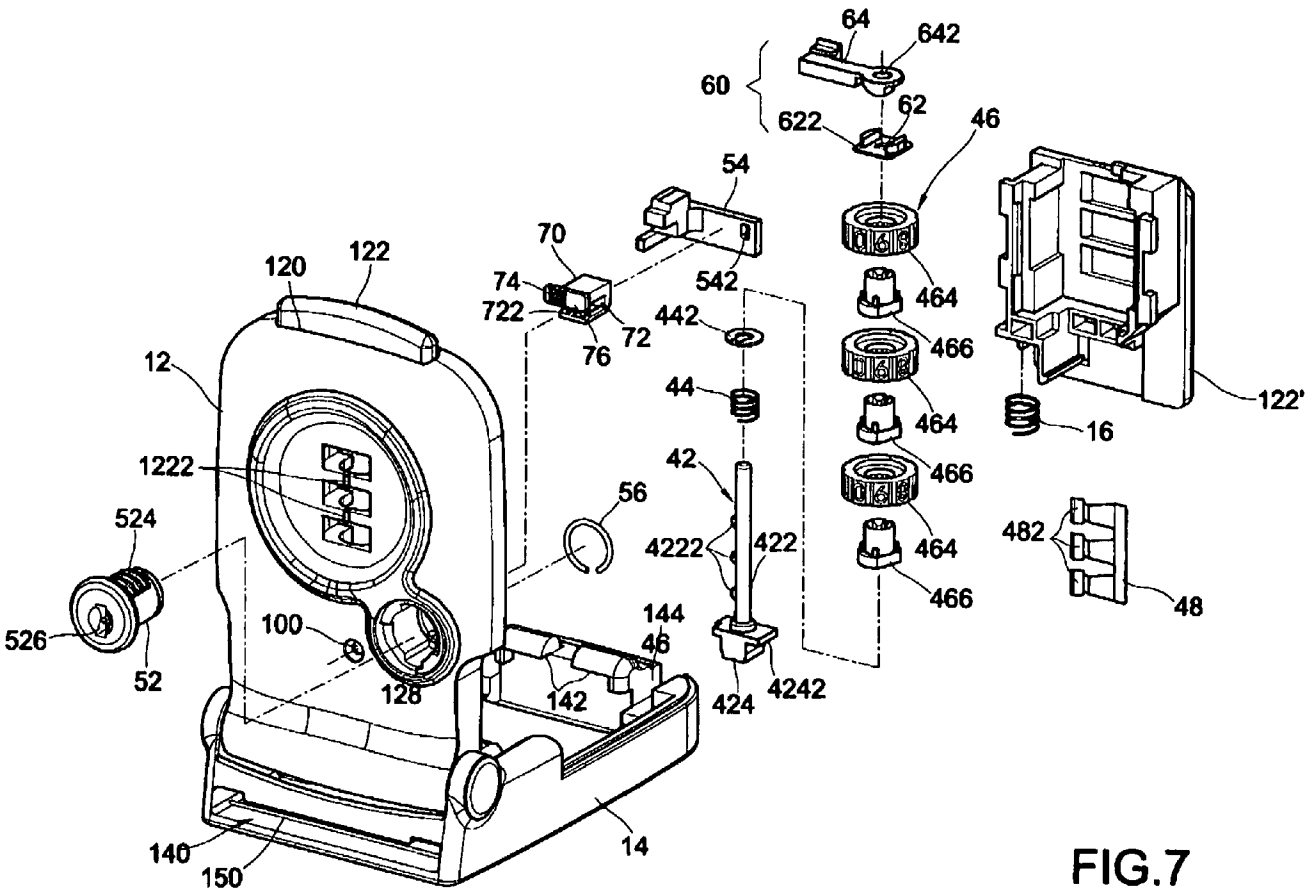
FIG. 7 is an exploded sketch of the lock body of the strap lock of the present invention from a different direction.
Figure 8:
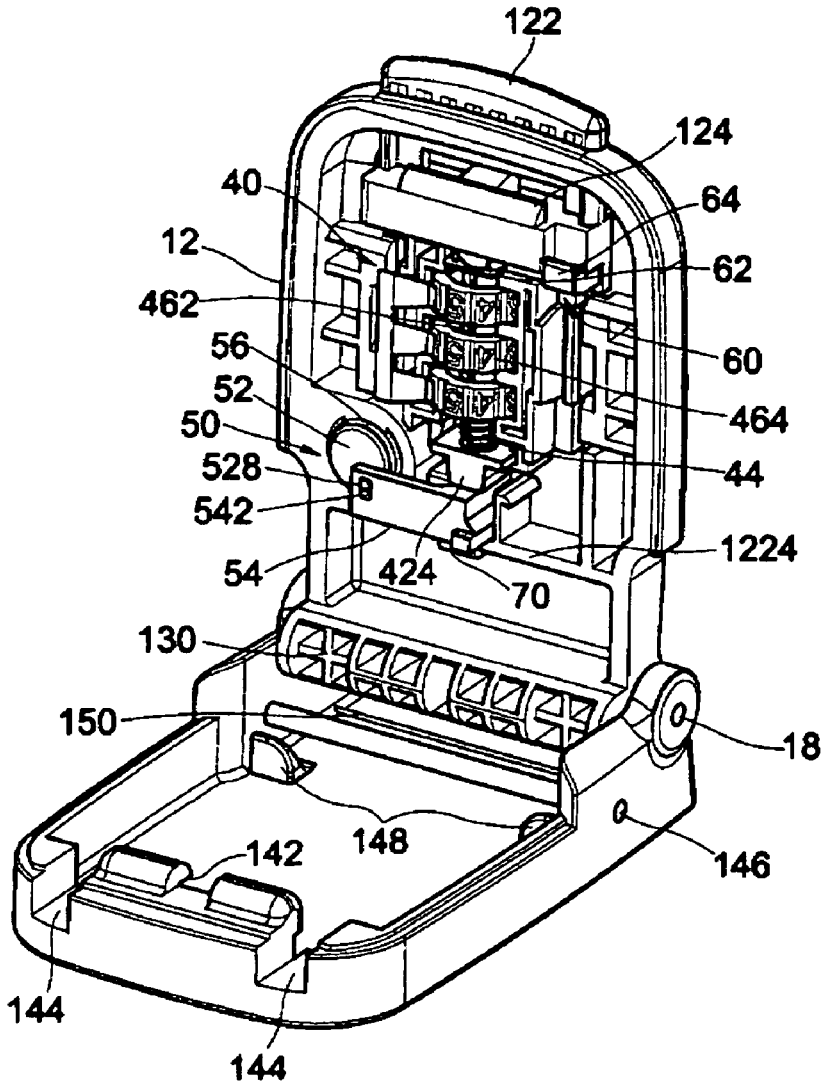
FIG. 8 is a perspective sketch of ignoring some components of the lock body of the present invention, the lock body is unlocked.

Please refer to FIG. 6 and FIG. 7, which are the three dimensional view of all the elements of the lock body 10 in different angles. FIG. 8 illustrates the state of the unlocked lock body 10 but ignoring some components. The lock body 10 includes the top cover 12 and the bottom cover 14. The top cover 12 and the bottom cover 14 are connected to each other by a pivotal axis 18, thus the two covers can be separated by lifting or covered together by rotating. The top cover 12 includes a sliding guide 120 for containing and button 122 is allowed to move linearly. In addition, an open is formed in the front end of the top cover 12 and the button 122 is protruding over the external said of the top cover 12 to be a force-applied portion.

The button 122 includes the first detaining portion 124, and the bottom cover 14 includes a second detaining portion 142. The first detaining portion 124 and the second detaining portion 142 cooperates for buckling each other when the top cover 12 is affixed to the bottom cover 14. The button 122 is an active member assembled on the top cover 12, and the top cover 12 includes a containing slot 126 for the combination locking mechanism 40. The button 122 further includes an assembling hood 122' to wrap and position to avoid movement and deconstruction of the assembled members.

The combination locking mechanism 40 includes an axis rod 42, a flexible member 44, a combination wheel set 46 assembled by a plurality of combination code wheels and a sensing piece; wherein the axis rod 42 includes a rod body 422 and a head 424 locating on an end edge of the rod body 422, and an outward extension of the head 424 is a shoulder 4242 so that the axis rod 42 is fixed in the containing slot 126 of the button 122 by means of the shoulder 4242.

The flexible member 44 and the combination wheel set 46 are inserted into the rod body 422 of the axis rod 42 simultaneously, furthermore, the flexible member 44 is between the head 424 and the combination wheel set 46, and the flexible member 44 against the head 424 may withstand the axis rod 42. After the flexible member 44 and the combination wheel set 46 surround the axis rod 42 according to aforesaid, the head 424 of the axis rod 42 and each combination code wheel 462 of the combination wheel set 46 may then be placed in a relative channel of the containing slot 126 of the button 122 at corresponding fixed position, therefore the combined member carried by the button 122 follows the movement of the button 122. After installing the combination wheel set 46 on the button 122, it lets the combination code wheels 462 protrode out of the button 122, therefore the combination code wheels 462 are exposed to the surface of the top cover 12 for axial stirring.

The combination code wheel 462 is a combined member by means of an external ring wheel 464 and an internal bushing 466. The center of the external ring wheel 464 is a joining hole 4642, and the internal bushing 466 includes a plurality of joining teeth 4664 to cooperate with the joining hole 4642. It is to combine the internal bushing 466 and the external ring wheel 464 by way of joining. Additionally, an axial hole 4662 of the internal bushing 466 is able to surround the axis body 422 of the axis rod 42.

A plurality of tooth portions 4222 protrude out of a surface of the axis body 422 of the axis rod 42. The axial hole 4662 of the internal bushing 466 comprise a gap comparatively, therefore each internal bushing 466 of the combination code wheel 462 is stirred to a position where the gap and the tooth portion 4222 are comparative, and the internal bushing 466 is axially moved toward the direction of pressing the flexible member 44. The internal bushing 466 may be taken off the external ring wheel 464. Under the condition, the external ring wheel 464 can be stirred to re-joint the internal bushing 466.

Besides, an external surface of the external ring wheel 464 is averagely divided into a plurality of surface fillisters 4644, a surface numeral 4646 or symbol is between any two surface fillisters 4644. However, according to aforesaid, each combination code wheel 462 includes the external ring wheel 464 and the internal bushing 466, and the external ring wheel 464 and the internal bushing 466 can be joined each other in different directions and angles. When the installment of the combination code wheel 462 and the button 122 is finished, all of the internal bushings 466 of the combination code wheels 462 are against each other. By way of re-joining the external ring wheels 464 and the internal bushings 466, the surface numeral 4646 of the external ring wheel 464 corresponding to a plurality of surface points 1222 of the button 122 can be predetermined before installing each combination code wheel 462. For example, the numeral of 0-0-0 is a combination code to allow the combination code wheel set 46 to move corresponding to the axis rod 42.

The sensing piece 48 is made of elastic material, and can be assembled with the assembling hood 122'; furthermore, the sensing piece 48 includes a plurality of flexible arms 482 to produce stirring friction force to each of the combination code wheels 462 for positioning.

To assure the flexible member 44 being against the combination wheel set 46 tightly and to avoid the flexible member 44 not against the combination wheel set 46 efficiently due to the larger, smaller or slant flexible member 44, a spacer 442 is added between the two joint surfaces of the flexible member 44 and the combination wheel set 46. The spacer 442 is formed to transmit the elastic force from the flexible member 44 to the combination wheel set 46.

Figure 9A:
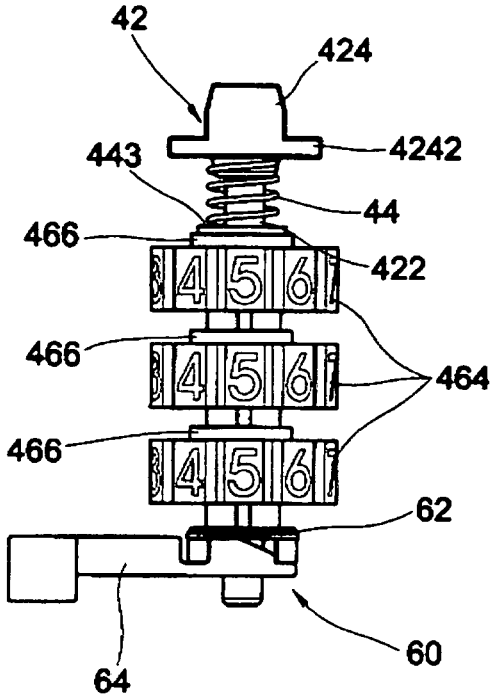
FIG. 9A is a partial perspective sketch of the present invention, which presents a combination locking mechanism and a cooperated combination code reset device.
Figure 9B:
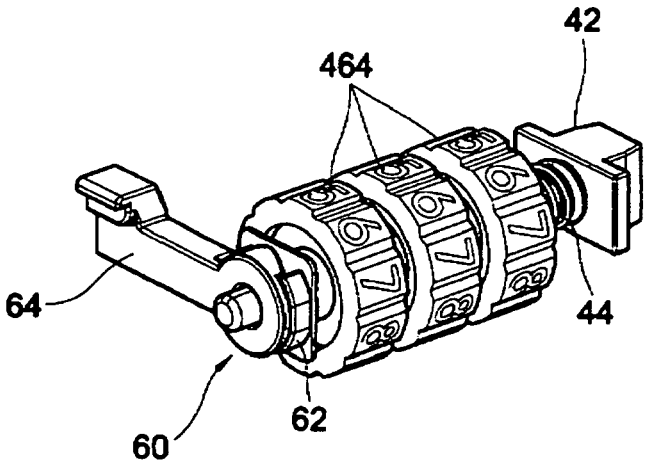
FIG. 9B is a top perspective view of the components of FIG. 9A.
Figure 10A:
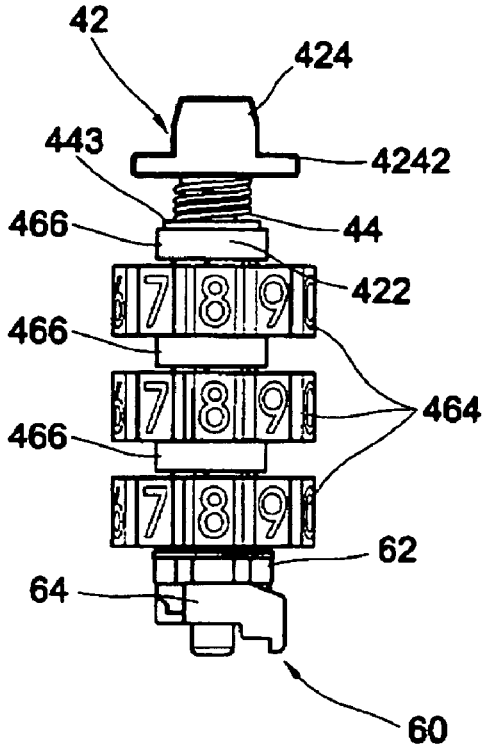
FIG. 10A is a top view of the partial present invention, which presents the situation of the combination locking mechanism and the combination code reset device being stirred and pushed.
Figure 10B:
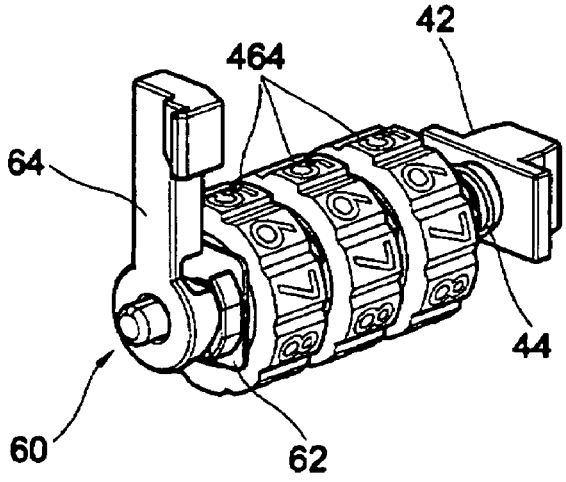
FIG. 10B is a front perspective view of FIG. 10A.

Please refer to FIG. 9A and FIG. 9B, the button 122 further includes a combination code reset device 60 comprising a stirring block 62 and a stirring rod 64. The stirring block 62 and a stirring rod 64 include an axial hole 622 and another axial hole 642 individually for penetrating through the rod body 422 of the axis rod 42 and being against a side of the combination wheel set 46 relative to the flexible member 44, thus the assembly of the stirring block 62 and a stirring rod 64 together with the axis rod 42 are installed on the button 122. Then, the combination of the assembly and the button 122 is constructed on the combination locking mechanism 40. Please refer to FIG. 10A and FIG. 10B, the stirring rod 64 is rotated to push the stirring block 62 for moving linearly when all of the combination code wheels 462 are stirred to the predetermined combination code positions. Thus all of the internal bushings 466 and the external ring wheels 464 are pushed to the positions for releasing; after the external ring wheels 464 move to different joining positions corresponding to the internal bushings 466, the stirring rod 64 stops pushing the stirring block 62, and the internal bushings 466 automatically go back to the positions where the internal bushings 466 join to the internal ring wheels 464. It makes the combination code changed from now on.

When the combination locking mechanism 40 and the combination code reset device 60 are installed together on the button 122, the assembling hood 122' lodged in the button 122 provides the functions of positioning and protection to avoid loosing members.

Besides the combination locking mechanism 40, the lock body 10 includes the key device 50 locked and unlocked by inserting and rotating a key K as well. The key device 50 includes a reacting member 52 and a braking member 54. The reacting member 52 is fit together with an assembling hole 128 of the top cover 12, then a buckling bolt 56 buckles up a ring slot 522 of the reacting member 52 so that the reacting member 52 combines with the top cover 12 by way of rotation. A plurality of thin pieces 524 are formed on the surface of the reacting member 52, and the thin pieces 524 are lodged into lodging slots 1282 in the assembling hole 128. That is, a proper key K is inserted into a key hole 526 on the surface of the top cover 12, and then all of the thin pieces 524 are drawn back to the reacting member 52, then the thin pieces 524 can be rotated by the key K.

The braking member 54 includes an embedding slot 542 and a long hole 544, and the long hole 544 wraps around and connects a slanted axis of an end surface of the reacting member 52. Thus the braking member 54 is driven simultaneously when the reacting member 52 is moved by inserting and rotating the key K.

Please be noted, when the key device 50 is installed on the top cover 12 as mentioned above, the braking member 54 is just against a head 424 of the axis rod 42, and thus an axial front end of the axis rod 42 is blocked.

After the combination locking mechanism 40, the combination code reset device 60 and the key device 50 are assembled together on the lock body 10 and the assembling hood 122' hooks up the button 122, a flexible member 16 can be put in the top cover 12 as well. An end of the flexible member 16 is against the internal of the top cover 12, another end wraps around to be against the button 122 or the assembling hood 122'. Therefore the button 122 is always kept in the position to buckle up with the bottom cover 14 by means of the pushing of the flexible member 16.

According to the figures, the lock body 10 further includes an indicator 70, and a window 100 locates on the top cover 12 of the lock body 10, thus the indicator 70 can be seen from outside of the lock body 10 through the window 100. The indicator 70 includes a clamping trough straddling on the guiding rail 1224, and a lodging block 1226 and a lodging slot 722 for positioning installed on a joint surface comparatively to lodge the indicator 70 onto the guiding rail 1224.

Along with aforesaid, the present invention discloses the lock body 10 simultaneously comprising the combination locking mechanism 40, the key device 50, the combination code reset device 60 and the indicator 70 shown by the window 100; besides, the lock body 10 is connected to the buckle 30 via the binder 20, the buckle 30 is hasped or separated from the lock body 10 when the lock body 10 is unlocked.

There are two types of operations for the lock body 10, one is to set up a combination code by the combination locking mechanism 40, another is operated by means of the key K and the key device 50. Thus the button 122, always keeping the lock body 10 under a locking state, can be driven and moved to a position where the lock body 10 being unlocked.

Figure 11:
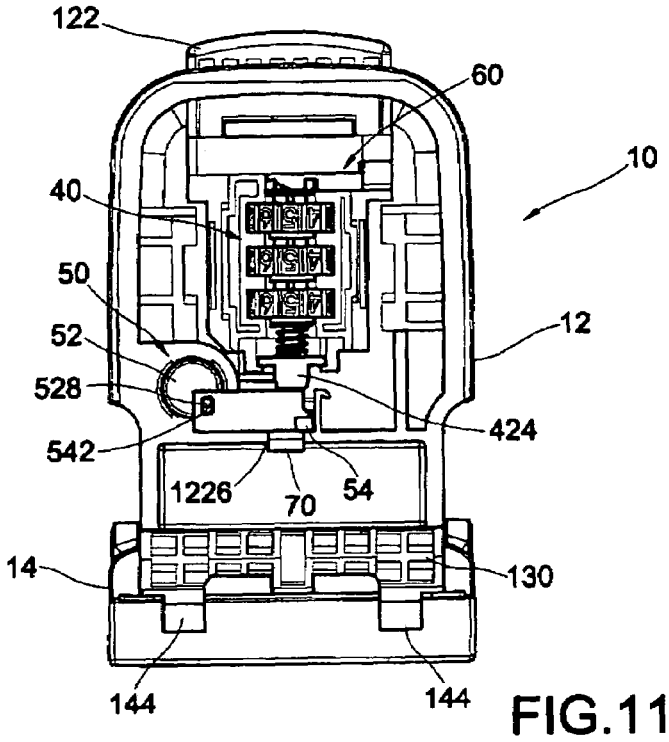
FIG. 11 is a front view of the lock body being opened vertically of the strap lock of the present invention when ignoring some components.
Figure 12:
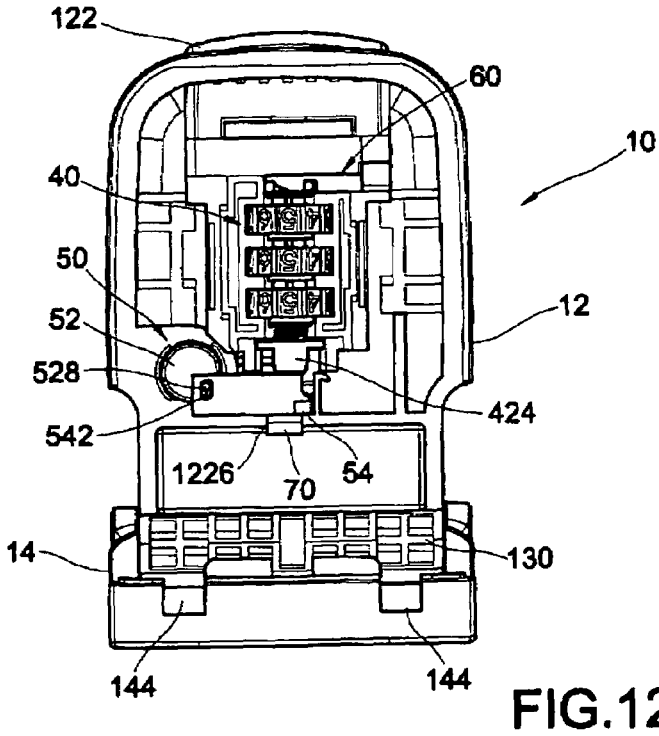
FIG. 12 is a sketch of variable situations of the force-applied button moving into the internal of the lock body of the present invention, when a combination code in the combination locking mechanism being correct of FIG. 11.

Please referring to FIG. 11, it shows that the state of the top cover 12 of the lock body 10 is vertically opened corresponding to the bottom cover 14 and the assembling hood 122', wherein the flexible member 16 and the sensing piece 48 are ignored. When the combination locking mechanism 40 hasping the button 122 is stirred to a correct combination code via each of the combination code wheel 462, and every gap of the internal bushing 466 is relative to the tooth portion 4222 of the axial rod 42, as shown in FIG. 12, the button 122 with the combination code wheel 462 and the combination code reset device 60 is moved toward the internal of the lock body, thus the first detaining portion 124 of the button 122 is also moved to release the second detaining portion 142 of the bottom cover 14 so as to that the lock body being unlocked.

Figure 13:
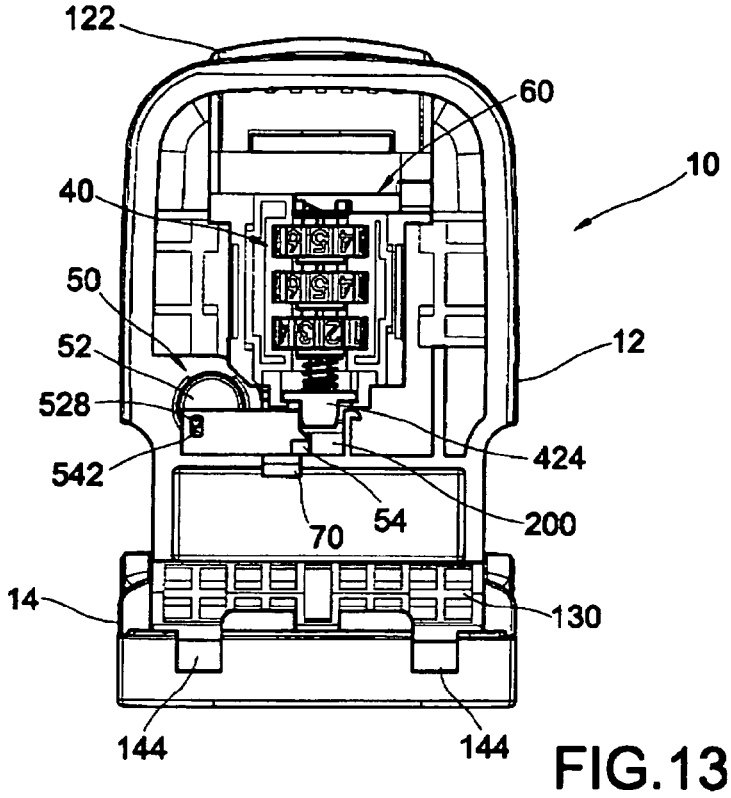
FIG. 13 is a sketch of variable situations of the key operating a key device and the force-applied button moving into the internal of the lock body of the present invention, when a combination code in the combination locking mechanism being incorrect of FIG. 11.

On the other hand, any one of the combination code wheels 462 of the combination locking mechanism 40 is not stirred to a correct position correspondingly, the button 122 is then not moved. Optionally the key device 50 can be operated to let the button 122 move for unlocking the lock body 10. As shown in FIG. 13, when the key K is inserted into the reacting member 52 via the key hole 526 of the top cover 12, and the reacting member 52 is driven to the position where the reacting member 52 is moved toward, the driven braking member 54 is also moved at the same time. Therefore, the braking member 54 is then moved toward the left of FIG. 13 to have an acting room 200, and the acting room 200 is reserved for the head 424 going in, thus the button 122 carrying with the whole combination locking mechanism 40, including the combination wheel set 46, and the combination code reset device 60 may be moved for lifting and unlocking the lock body 10.

Figure 14:
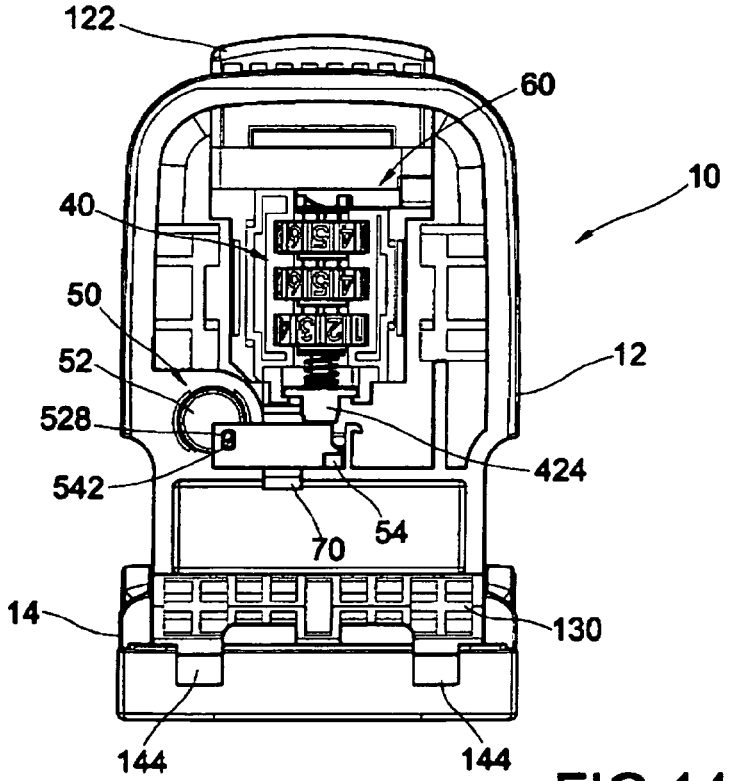
FIG. 14 is a sketch of variable situations of the key device being reset, when the force-applied button of FIG. 13 is released.

As shown in FIG. 14, when the button 122 is not applied by force, then, the button 122 is back to a normal position thereof by means of the flexible member 16. The key K reversely turns the reacting member 52, and the braking member 54 is also back to its original position where blocking the head 424 of the axis rod 42.

Please referring to both FIG. 13 and FIG. 14, FIG. 13 shows that the indicator 70 is placed on a first position normally, and the indicator 70 may be shifted to a second position by the braking member 54 after unlocking the lock body 10 by means of the key K and the key device 50, and the second position is shown as in FIG. 16; the indicator 70 keeps stopping on the second position when the lock body 10 being locked again by means of the key K and the key device 50.

Figure 15A:
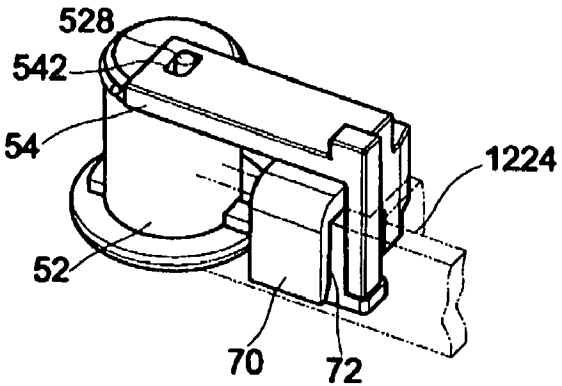
FIG. 15A is a perspective sketch of the partial present invention.
Figure 15B:
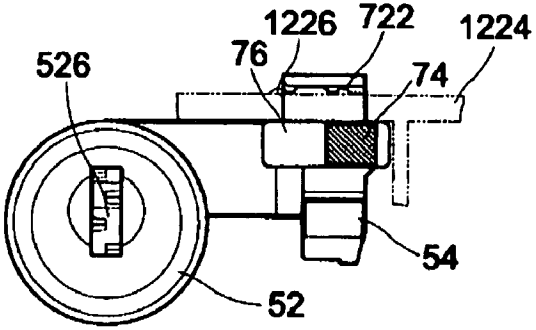
FIG. 15B is a top view of FIG. 15A.

Please referring to both FIG. 15A and FIG. 15B, the figures show the connection relationship of the reacting member 52, the braking member 54, the indicator 70 and the guiding rail 1224. As shown in the figures, the lock body 10 includes the window 100 for displaying the indicator 70. The indicator 70 includes a first surface area 74 for displaying the first position and a second surface area 76 for displaying the second position, wherein there are two different colors for the first surface area 74 and the second surface area 76 individually. For example, the first surface area 74 is represented by green color, and the second surface area 76 is represented by red color. Besides, there are two different icons represented for the first surface area 74 and the second surface area 76 individually on the indicator as well.

Figure 16A:
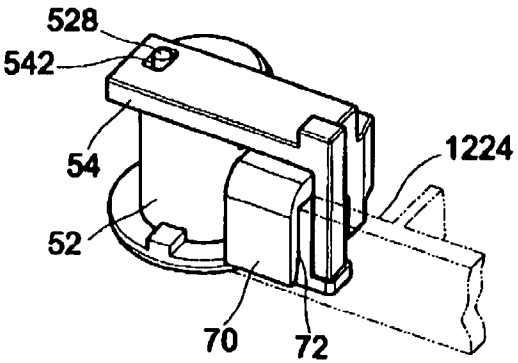
FIG. 16A is a perspective sketch of the partial present invention, which presents the variable situations of an indicator being driven by the key device.
Figure 16B:
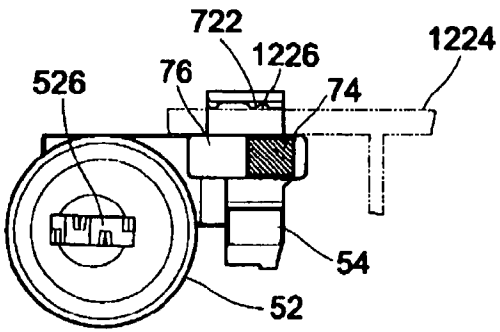
FIG. 16B is a top view of FIG. 16A.

When the reacting member 52 is driven by inserting and rotating the key K, the reacting member 52 is shifted to the positions shown as in FIG. 16A and FIG. 16B, and the indicator 70 straddling on the guiding rail 1224 may be driven by the braking member 74. The indicator 70 is moved from the first surface area 74 relative to the window 100 to the second surface area 76 relative to the window 100.

Please be noted that the braking member 54 only drives the indicator 70 in one direction. When the key K reversely operates the key device 50 again, the indicator 70 remains on the second position.

Hence, when the present invention is applied to a baggage case and the strap lock of the present invention may be unlocked by the key K for checking, the indicator 70 is shifted from the original first position to the second position. It is to let the owner of the baggage case know whether the baggage is opened or not. To return the indicator 70 to the first position, the only way is to unlock the lock body 10 by a combination code and stir by hand.

As aforesaid, the strap lock provided by the present invention is assured for binding baggage. Even if the baggage case is delivered or checked, the strap lock can be unlocked by an override key; furthermore, it is re-locked after checking to avoid damage.

In addition, the strap lock cooperates with the indicator with the feature of reset. The indicator may appear the situation that the strap lock is unlocked by a key, so the owner is notified by the two conditions of the strap lock being unlocked for safety checking or someone attempting to unlock the strap lock.

When the invention described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A strap lock with both functions of combination code setting and key operation comprising:

a lock body being unlocked and locked;

a buckle having a first end and a second end, the first end hasping or separating from the lock body, the second end connecting the lock body by means of a binder;

wherein the lock body has a button and a combination locking mechanism, the button is for unlocking and locking the lock body, the combination locking mechanism is to control the button for unlocking, the lock body further has a key device to control the button for unlocking, wherein the lock body further has an indicator linearly shiftable from a first position to a second position.

2. The strap lock with both functions of combination code setting and key operation according to claim 1, wherein the lock body pivotally connects a top cover and a bottom cover, the button is formed on the top cover to hook up the bottom cover.

3. The strap lock with both functions of combination code setting and key operation according to claim 2, wherein the lock body has a flexible member against the button such that the button is pushed by the flexible member to hook up the bottom cover.

4. The strap lock with both functions of combination code setting and key operation according to claim 1, wherein the indicator is placed on the first position normally, the indicator is shifted to the second position after unlocking the lock body by means of a key and the key device, and the indicator stays at the second position while the lock body is locked again.

5. The strap lock with both functions of combination code setting and key operation according to claim 4, wherein the lock body has a window for displaying the indicator.

6. The strap lock with both functions of combination code setting and key operation according to claim 5, wherein the indicator has a first surface area for displaying the first position and a second surface area for displaying the second position.

7. A strap lock with both functions of combination code setting and key operation comprising:

a lock body being unlocked and locked and having a button optionally kept on an unlocking position for the locked lock body engaging an unlocking action and optionally kept on a locking position for the locked lock body engaging an unlocking action; a combination locking mechanism for the button being kept on the unlocking position, and a key device having a reacting member and a braking member for accepting and rotationally driving a key, the braking member optionally accepting the button and the combination locking mechanism for moving together to unlock the lock body, wherein the lock body further has an indicator linearly shiftable from a first position to a second position; and a buckle having a first end and a second end, the first end hasping or separating from the lock body, the second end connecting the lock body by means of a binder.

8. The strap lock with both functions of combination code setting and key operation according to claim 7, wherein the lock body pivotally connects a top cover and a bottom cover, the button is combined with the top cover and hooked up the bottom cover.

9. The strap lock with both functions of combination code setting and key operation according to claim 8, wherein the lock body has a flexible member against the button is to maintain that the button hooking up the bottom cover.

10. The strap lock with both functions of combination code setting and key operation according to claim 7, wherein the lock body defines a sliding guide for moving the button linearly.

11. The strap lock with both functions of combination code setting and key operation according to claim 7, wherein the reacting member drives rotationally the braking member for moving linearly.

12. The strap lock with both functions of combination code setting and key operation according to claim 11, wherein the reacting member has a slanted axis to connect the braking member.

13. The strap lock with both functions of combination code setting and key operation according to claim 7, wherein the indicator is placed on the first position normally, the indicator is shifted to the second position after unlocking the lock body by means of a key and the key device, and the indicator stays at the second position while the lock body is locked again.

14. The strap lock with both functions of combination code setting and key operation according to claim 13, wherein the indicator is driven by the braking member and moved from the first position to the second position.

15. The strap lock with both functions of combination code setting and key operation according to claim 13, wherein the lock body has a window for displaying the indicator.

16. The strap lock with both functions of combination code setting and key operation according to claim 13, wherein the indicator has a first surface area for displaying the first position and a second surface area for displaying the second position.

17. A strap lock with both functions of combination code setting and key operation comprising:

a lock body being unlocked and locked and having a combination locking mechanism for unlocking the lock body via combination codes; a key device for unlocking the lock body; and an indicator placed on a first position normally, and the indicator being line shifted to a second position after unlocking the lock body by means of a key and the key device, the indicator staying at the second position while the lock body is locked again by the key and the key device;

a buckle having a first end and a second end, the first end hasping or separating from the lock body while the lock body is unlocked, the second end connecting the lock body by means of a binder.

18. The strap lock with both functions of combination code setting and key operation according to claim 17, wherein the lock body has a window for displaying the indicator.

19. The strap lock with both functions of combination code setting and key operation according to claim 17, wherein the indicator has a first surface area for displaying the first position and a second surface area for displaying the second position.

* * * * *